US011566637B2

(12) United States Patent
Ebersole et al.

(10) Patent No.: US 11,566,637 B2
(45) Date of Patent: Jan. 31, 2023

(54) CEILING FAN HANGER ASSEMBLY

(71) Applicant: HUNTER FAN COMPANY, Memphis, TN (US)

(72) Inventors: Ryan Nicholas Ebersole, Murfreesboro, TN (US); Phillip Santolucito, Sun City, CA (US); John Anthony Burns, Franklin, TN (US)

(73) Assignee: Hunter Fan Company, Memphis, TN (US)

( * ) Notice: Subject to any disclaimer, the term of this patent is extended or adjusted under 35 U.S.C. 154(b) by 422 days.

(21) Appl. No.: 16/545,174

(22) Filed: Aug. 20, 2019

(65) Prior Publication Data

US 2020/0063759 A1 Feb. 27, 2020

Related U.S. Application Data

(60) Provisional application No. 62/720,154, filed on Aug. 21, 2018.

(51) Int. Cl.
*F04D 29/64* (2006.01)
*F04D 25/08* (2006.01)

(52) U.S. Cl.
CPC ..... *F04D 29/646* (2013.01); *F04D 25/088* (2013.01)

(58) Field of Classification Search
CPC ..... F04D 29/646; F04D 25/088
USPC ..... 248/667
See application file for complete search history.

(56) References Cited

U.S. PATENT DOCUMENTS

| | | | | |
|---|---|---|---|---|
| 2,907,545 | A | 10/1959 | Beck et al. | |
| 7,503,536 | B2 | 3/2009 | Friederich et al. | |
| 7,874,798 | B2 * | 1/2011 | Frampton | F04D 25/088 416/246 |
| 8,152,453 | B2 * | 4/2012 | Oleson | F04D 25/088 416/246 |
| 2009/0035144 | A1 * | 2/2009 | Wang | F04D 25/088 416/220 R |
| 2009/0072108 | A1 * | 3/2009 | Oleson | F16M 11/10 248/282.1 |
| 2017/0030361 | A1 * | 2/2017 | Niemiec | F04D 25/088 |
| 2017/0101998 | A1 | 4/2017 | Yamamoto et al. | |
| 2017/0204869 | A1 * | 7/2017 | Horng | F04D 29/601 |

(Continued)

FOREIGN PATENT DOCUMENTS

| | | | |
|---|---|---|---|
| CN | 202493565 | U1 | 10/2012 |
| CN | 103410793 | A | 11/2013 |
| CN | 103411844 | A | 11/2013 |

(Continued)

OTHER PUBLICATIONS

Http://www.beamupusa.com/mounts/sharp/projector-ceiling-mount-for-sharp-xr-32s-xr-32x, "Projector Ceiling Mount for Sharp XR-32S XR32X", 2 pgs, accessed Dec. 5, 2017.

(Continued)

*Primary Examiner* — Logan M Kraft
*Assistant Examiner* — John D Bailey
(74) *Attorney, Agent, or Firm* — McGarry Bair PC

(57) ABSTRACT

A ceiling fan hanger assembly includes a mount plate with a pair of plate extensions and a downrod having a pair of spaced downrod extensions. A connector bracket pivotally couples to the plate extensions to define a first pivot axis and pivotally couples to the downrod extensions to define a second pivot axis different than the first pivot axis.

15 Claims, 7 Drawing Sheets

(56) References Cited

U.S. PATENT DOCUMENTS

2018/0112680 A1 4/2018 Tang et al.

FOREIGN PATENT DOCUMENTS

| | | | |
|---|---|---|---|
| CN | 204437635 | U | 7/2015 |
| CN | 206409402 | U | 8/2017 |
| CN | 206647287 | U | 11/2017 |
| CN | 206785694 | U | 12/2017 |
| CN | 107559240 | S | 1/2018 |
| CN | 210660671 | U | 6/2020 |
| WO | 2017181350 | A1 | 10/2017 |

OTHER PUBLICATIONS

Https://www.ebay.com/itm/Universal-Extendable-Tilt-DLP-LCD-Ceiling-Projector-Mount-Bracket-44-lbs-Black/172517534341?epid=579572491&hash=item282ad8aa85:g:vD0AAOSwpDdVZBeX, Universal Extendable Tilt DLP LCD Ceiling Projector Mount Bracket Black, 5 pgs, accessed Dec. 5, 2017.

Https://www.ebay.com/itm/OPTOMA-TECHNOLOGY-OCM818B-RU-Low-Profile-Universal-Ceiling-Mount-Projector/322227891282?epid=1738366599&hash=item4b06476c52:g:75AAAOSw65FXsKhw, Optoma Technology Low Profile Universal Ceiling Mount Projector, Model No. OCM818B-RU, 4 pgs, accessed Dec. 5, 2017.

Https://curtisuniversal.com/, Curtis Universal Joint Company—U-Joints and TakeApart Design, 2 pgs, accessed Dec. 5, 2017.

Http://mnhpva.org/meetings/Jan_03/Trike.html, Mark Stonich's "U" Joint Steering, 2 pgs, accessed Dec. 5, 2017.

Https://www.amazon.com/TEKTON-4964-Impact-Universal-3-Piece/dp/B000NPZ40I, TEKTON 4964 Impact Universal Joint Set, 3-piece, Model No. B000NPZ401, 11 pgs, accessed Dec. 5, 2017.

* cited by examiner

CEILING FAN HANGER ASSEMBLY

CROSS-REFERENCE TO RELATED APPLICATIONS

This application claims the benefit of and priority to U.S. Provisional Patent Application No. 62/720,154, filed Aug. 21, 2018, the entirety of which is incorporated herein by reference.

BACKGROUND OF THE INVENTION

Ceiling fans are used to generate airflow within a space or area, often used for cooling or temperature regulation. Ceiling fans can be used in industrial, commercial or other suitable environments to circulate air to maintain proper temperature regulation. Often, the ceiling fan is suspended from the ceiling of a building structure, or other structural elements of the building structure at the ceiling, such as beams or girders for example.

Suspension of the ceiling fan includes mounting a portion of the ceiling fan, such as a mounting bracket, to the ceiling or building structural elements. The remainder of the ceiling fan is then coupled to the mounting bracket and suspended within the area. Often, mounting and suspending the ceiling fan can be challenging for an installer. Furthermore, if the ceiling or building structure is provided at an angle, the suspension of the ceiling fan must account for such an angle.

BRIEF DESCRIPTION OF THE INVENTION

In one aspect, the disclosure relates to a ceiling fan hanger assembly including a mount plate having a pair of spaced plate extensions; a downrod having opposing first and second ends including a pair of spaced downrod extensions extending from the first end which overlap the plate extensions; and a connector bracket pivotally connected to the plate extensions to define a first pivot axis, and pivotally connected to the downrod extensions to define a second pivot axis, which is different from the first pivot axis.

In another aspect, the disclosure relates to a ceiling fan hanger assembly including a mount plate including a pair of spaced plate extensions with each plate extension having a plate extension aperture; a downrod with a first end and a second end, and a downrod mount provided at the first end having a bottom wall and a pair of spaced downrod extensions extending from the bottom wall each including a downrod extension aperture; and a connector bracket pivotally connected to the plate extensions at the plate extension apertures to define a first pivot axis, and pivotally connected to the downrod extensions at the downrod extension apertures to define a second pivot axis, which is perpendicular to the first pivot axis.

In yet another aspect, the disclosure relates to a ceiling fan hanger assembly including a mount plate with a pair of opposing plate extensions each having a plate extension aperture; a downrod including a downrod mount having a pair of opposing downrod extensions each including a downrod extension aperture; and a connector bracket including four sidewalls with each sidewall including an opening with a set of bushings provided in the openings; wherein the connector bracket pivotally connects to the plate extensions to define a first pivot axis and pivotally connects to the downrod extensions to define a second pivot axis, and the first pivot axis and the second pivot axis pivots about the set of bushings.

DESCRIPTION OF EMBODIMENTS OF THE INVENTION

The description herein is directed to systems, methods, and other devices related to a ceiling fan. More specifically, the description relates to a ceiling fan hanger assembly for suspending a ceiling fan. The ceiling fan hanger assembly provides for 360-degree pivoting movement of the ceiling fan to hang or suspend the ceiling fan in a manner that is level with the floor beneath the fan or a horizontal plane, regardless of the orientation of the structure from which the ceiling fan is suspended. The ceiling fan hanger assembly further provides for simplification of manufacture and assembly, as the ceiling fan hanger assembly can provide or reduced manufacture costs and can facilitate installation of the ceiling fan.

As used herein, a set can include any number of a particular element, including only one or more than one. For example, a set of fasteners can include one or more fasteners.

Figure 1:
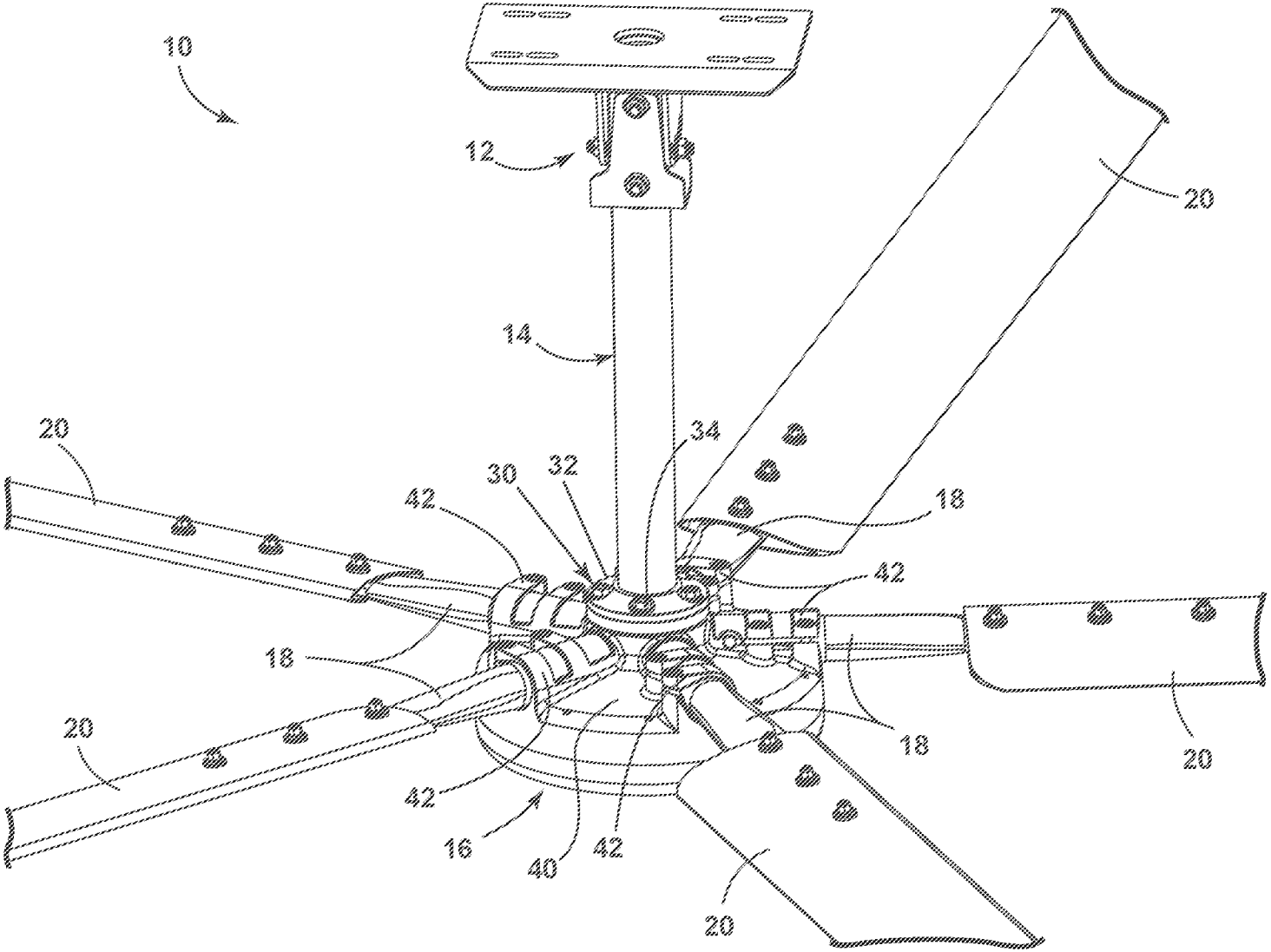
FIG. 1 is a view of a ceiling fan having a hanger assembly for suspending the ceiling fan.

FIG. 1 illustrates a top perspective view of a ceiling fan 10 including a ceiling fan hanger assembly 12 for mounting to a ceiling (not shown) or a structure. The ceiling fan includes a downrod 14, a motor assembly 16, a set of blade holders 18, and a set of blades 20. An adapter assembly 30 can couple the downrod 14 to the motor assembly 16, and can include an adapter plate 32 provided at the base of the downrod 14 configured to mount to the motor assembly 16, a motor shaft (not shown), or any other attachment member configured to suspend the motor assembly 16 from the downrod 14. In one example, a set of fasteners 34 can be utilized to couple the adapter plate 32 to the motor assembly 16.

The motor assembly 16 can include a housing 40. A set of blade hubs 42 can be provided on the housing 40. The set of blade hubs 42 can be configured to receive and couple to the set of blade holders 18, which can be used to couple the blades 20 to the motor assembly 16 for rotatably driving the blades 20. The motor assembly 16 can house a motor (not shown) such as a permanent magnet type motor including a stator and a rotor in one non-limiting example. A supply of power can be used to drive the rotor about the stator to rotate the motor housing 40, and thereby rotating the blades 20 coupled to the motor housing 40 via the blade holders 18.

Figure 2:
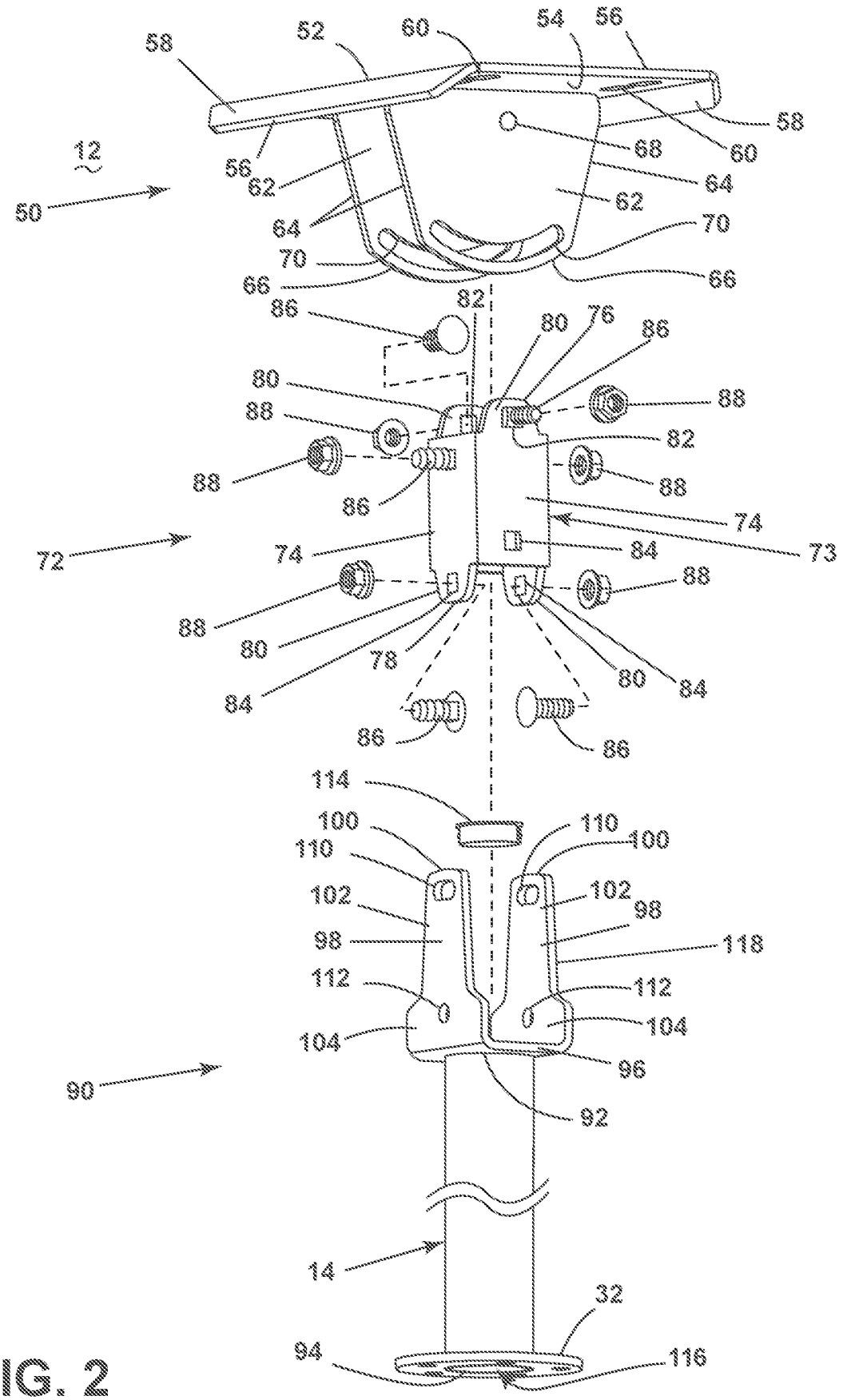
FIG. 2 is an exploded view of the hanger assembly of FIG. 1.

Referring now to FIG. 2, the ceiling fan hanger assembly 12 includes a mount plate 50, a connector bracket 72, and a downrod mount 90, where the connector bracket 72 provides for connecting the mount plate to the downrod mount 90. The mount plate includes an upper surface 52 and a lower surface 54, with edges 56 around the periphery of the mount plate 50. The mount plate 50 further includes a pair of flanges 58, a set of apertures 60, and plate extensions 62. The pair of flanges 58 are formed as angled portions of the mount plate 50, offset from the planar surface of the remainder of the mount plate 50. As shown, the pair of flanges 58 angle in the direction of the lower surface 54 of the mount plate 50, while other configurations are contemplated, such as angling toward the upper surface 52. The set of apertures 60 are provided in the mount plate 50, while it is contemplated that the apertures 60 can be provided in the pair of flanges 58. While a set of either apertures 60 are shown herein, any suitable number of apertures 60 is contemplated, as may be suitable for manufacture, structural integrity of the mount plate, or overall weight reduction.

The plate extensions 62 can further be described as a pair of plate extensions 62 that are arranged parallel to one another, and can be shaped similar or identical to one another, while it is contemplated that the extensions can be shaped or oriented different from one another. The plate extensions 62 can extend perpendicular from the lower surface 54 of the mount plate 50. Each plate extension 62 can include a set of linear edges 64 which terminate at a bottom edge 66. The bottom edge 66 can be arcuate, with a convex curvature. Each plate extension 62 can further include a pair of apertures, with each plate extension 62 having a first plate extension aperture 68 and a second plate extension aperture 70. The first plate extension aperture 68 can be a rounded or circular aperture adapted to receive a rounded fastener, such as a screw or bolt, and can be positioned nearer the mount plate 50 relative to the second plate extension aperture 70. The second plate extension aperture 70 can be an elongated, arcuate aperture, and can have a curvature complementary to the bottom edge 66, for example. Furthermore, the second plate extension aperture 70 can have a curvature or arc that defines a centerpoint positioned at the first plate extension aperture 68. The plate extensions 62 can be welded to the mount plate 50, for example, or can be stamped as a part of the mount plate 50 and bent into the position as shown in FIG. 2. In the present example, the plate extensions 62 are welded to the mount plate 50, as the sizing of the plate extensions 62 would not permit a stamping and bending formation. A smaller size for the plate extensions 62 can better provide for the stamping and bending form of manufacture.

The connector bracket 72, which includes a body 73 that includes a set of four sidewalls 74 to define a square cross-sectional profile taken perpendicular to each of the sidewalls 74, while any number of sidewalls is contemplated. Each sidewall 74 terminates at a top edge 76 and bottom edge 78. Each sidewall 74 further includes a tab 80 at least partially forming one of the top edge 76 or the bottom edge 78, while it is contemplated that each sidewall can include a tab 80 at both of the top and bottom edges 76, 78. The tabs 80 are arranged in an offset manner among the four sidewalls 74, such that opposing sidewalls 74 include similarly arranged tab 80. More specifically, two opposing sidewalls 74 each include the tab 80 extending from the top edge 76, and the remaining two opposing sidewalls 74 each include the tab 80 extending from the bottom edge 78. Each sidewall 74 also includes a pair of openings, as an upper opening 82 and a lower opening 84. Each tab 80 includes one of the upper opening 82 or the lower opening 84, while the remaining aperture is provided adjacent to the top edge 76 or the bottom edge 78 opposite the tab 80 for each sidewall 74. The upper and lower openings 82, 84 can be spaced complementary to the first and second plate extension apertures 68, 70 on each plate extension 62. As shown, the upper and lower openings 82, 84 can be square-shaped, while any suitable opening shape is contemplated, such as a circle in one non-limiting example. The square-shape provides for minimizing or preventing rotation of an installed fastener, to minimize loosening of the ceiling fan hanger assembly 12.

A set of fasteners 86 can be included with the ceiling fan hanger assembly 12, with each fastener of the set of fasteners having a complementary nut 88 or other fastener-securing element. The set of fasteners 86 can be complementary to the upper and lower openings 82, 84 formed in the connector bracket 72, and can include a square shape complementary to the square shape of the upper and lower openings 82.

The downrod 14 can include an upper end 92 and a lower end 94, with the downrod mount 90 arranged at the upper end 92 and the adapter plate 32 arranged at the lower end 94. The downrod 14 can be hollow, defining an interior 116 for the downrod 14. A bushing 114 can be provided at the upper end 92 of the downrod. The bushing 114 can be sized complementary to the interior 116 of the downrod 14, and can be used to provide a smoother surface for items passing into the interior of the downrod 14, such as electrical wiring, for example.

The downrod mount 90 and the downrod 14 can be a one-piece assembly, such as cast or formed integral with one another, and can be a monolithic or unitary structure, while it is contemplated that the downrod mount 90 affixes to the downrod 14, such as by welding for example. The downrod mount 90 can include a bottom wall 96 sized to be larger than the diameter of the downrod 14 such that the bottom wall 96 extends radially wider than the remainder of the downrod 14. A pair of downrod extensions 98 can extend from the bottom wall 96 opposite of the downrod 14. The downrod extensions 98 can be arranged parallel to one another, and can be substantially planar members terminating at a peripheral edge 100. The downrod extensions 98 can be identical to one another, while it is contemplated that each extension is unique or are arranged non-parallel to one another. Each downrod extension 98 can include a upper portion 102 and a lower portion 104, with the lower portion 104 being wider than the upper portion 102, and the upper portion 102 being longer than the lower portion 104, relative to the longitudinal extent of the downrod 14. The upper portion 102 can include a taper 118 extending away from the downrod 14, defining a decreasing width for the upper portion 102 extending toward the peripheral edge 100. A first downrod extension aperture 110 can be provided in the upper portion 102 and a second downrod extension aperture 112 can be provided in the lower portion 104. The first and second downrod extension apertures 110, 112 can be spaced complementary to the upper and lower openings 82, 84 on the connector bracket 72. The first downrod extension aperture 110 can be an elongated, arcuate aperture, and can have a curvature complementary to the peripheral edge 100. The second downrod extension aperture 112 can be a circular, rounded aperture, and can be positioned at a centerpoint based upon the curvature of the first downrod extension aperture 110.

In assembling the ceiling fan hanger assembly 12, the connector bracket 72 can be inserted between the plate extensions 62 of the mount plate 50. The upper openings 82 positioned in the tab 80 adjacent the top edge 76 of the connector bracket 72 are aligned adjacent to the first plate extension aperture 68 in the plate extensions 62. Two fasteners of the set of fasteners 86 can be provided through the aligned upper openings 82 and the first plate extension apertures 68 to mount the connector bracket 72 to the mount plate 50. In this way, the second plate extension apertures 70 of the plate extensions 62 are aligned with the lower openings 84 in the connector bracket 72. Two additional fasteners of the set of fasteners 86 can be provided through the aligned second plate extension apertures 70 and the lower openings 84, coupling the mount plate 50 to the connector bracket 72 at a pair of second positions. In this way, the connector bracket 72 couples to the mount plate 50 at the plate extensions 62 at two opposing sidewalls 74 of the connector bracket 72.

The downrod mount 90 of the downrod 14 can be positioned with the downrod extensions 98 on opposing sidewalls 74 of the connector bracket 72, offset from and unoccupied by the plate extensions 62 already coupled to the connector bracket 72. The decreased width of the upper portions 102 are sized to fit between the spaced plate extensions 62 coupled to the connector bracket 72. In this way, the downrod extensions 98 are positioned along the remaining, unoccupied sidewalls 74 of the connector bracket 72, and between and perpendicular to the plate extensions 62. The first downrod extension apertures 110 in the downrod extensions 98 can align with the upper openings 82 in the connector bracket 72 that are not provided in the tabs 80. The second downrod extension apertures 112 can then align with the lower openings 84 in the connector bracket 72 positioned in the tabs 80 along the bottom edge 78. Four fasteners of the set of fasteners 86 can be utilized to mount the four downrod extension apertures 110, 112 in the downrod extensions 98 to the first and second openings 82, 84 in the connector bracket 72.

In mounting the connector bracket 72 to the mount plate 50 at the plate extensions 62 and mounting the connector bracket 72 to the downrod mount 90, the downrod 14 is effectively coupled to the mount plate 50. Thus, in mounting the mount plate 50 to a ceiling or structure, the ceiling fan hanger assembly 12 can be used to suspend the ceiling fan 10 from a ceiling or structure via the connector bracket 72.

Figure 3:
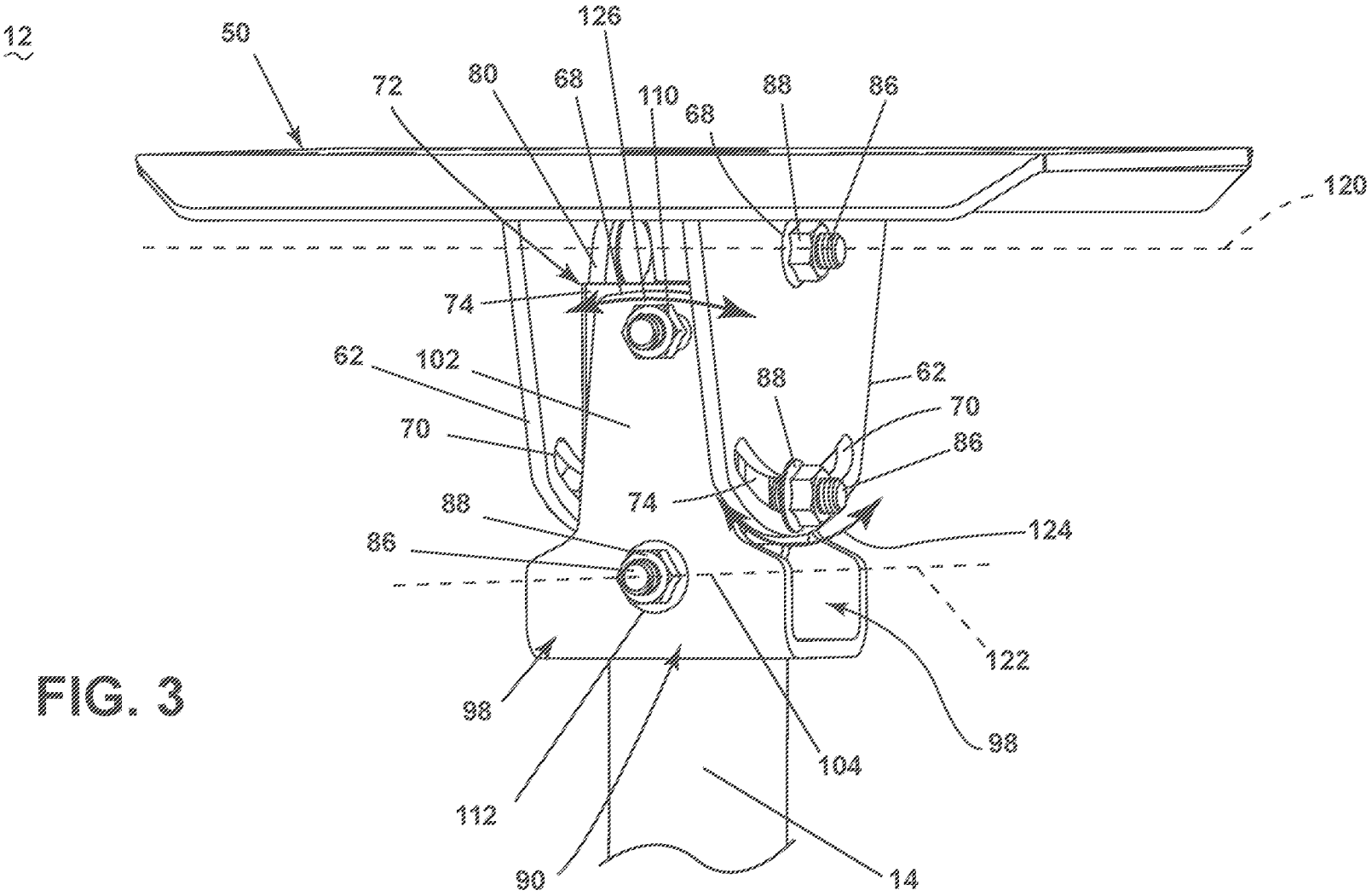
FIG. 3 is a view of the assembled hanger assembly of FIG. 2, showing pivoting movement about two pivot axes.

Referring now to FIG. 3, showing the assembled ceiling fan hanger assembly 12, the connector bracket 72 includes two sidewalls 74 aligned against and coupled to the plate extensions 62 of the mount plate 50, and with the remaining two sidewalls 74 aligned against and coupled to the downrod extensions 98 of the downrod mount 90 via the set of fasteners 86 and complementary nuts 88. In this position, the downrod extensions 98 have the upper portion 102 positioned between the plate extensions 62, while the lower portions 104 of the downrod extensions 98 are positioned beneath and spaced from the plate extensions 62.

The ceiling fan hanger assembly 12 provides for suspending the ceiling fan 10 as well as providing for pivoting the ceiling fan 10 in order to orient the ceiling fan in a level, horizontal position. Some structures, such as a ceiling, can include an angled wall, surface, or orientation and require a pivoting arrangement for hanging the ceiling fan in a level manner. The ceiling fan hanger assembly 12 provides for pivoting about two pivoting axes 120, 122 in order to orient the ceiling fan in either a level manner, or a particular pivoted orientation that differs from that of a standard installation. For example, the ceiling fan hanger assembly 12 can provided for a level mount at an angled ceiling. Furthermore, the ceiling fan hanger assembly 12 can provide for an angled mount for the ceiling fan suspended from a horizontal ceiling. In one example, the two pivoting axes 120, 122 can be arranged perpendicular to and offset from one another.

The connection between the plate 50 and the connector bracket 72 defines a first pivot axis 120 through the fasteners 86 in the first plate extension apertures 68. In this way, the connector bracket 72 can pivot about the first pivot axis 120 relative to the plate 50, as represented by arrow 124. When pivoting about the first pivot axis 120, the fasteners 86 in the second plate extension aperture 70 can slide along the elongated, curved length of the second plate extension apertures 70, where pivoting movement about the first pivot axis 120 is limited by the length of the second plate extension apertures 70. Furthermore, the length of the second plate extension apertures 70 should be such that there is no interference between the mount plate 50 and the downrod mount 90 during pivoting movement.

Similarly, the connection between the connector bracket 72 and the downrod mount 90 defines a second axis of rotation 122 through the fasteners in the second downrod extension apertures 112. In this way, the downrod mount 90, and therefore the downrod 14 and ultimately the remainder of the hanging ceiling fan 10, can pivot about the second axis of rotation 122 relative to the connector bracket 72, as represented by arrow 126. When pivoting about the second axis of rotation 122, the fasteners 86 in the first downrod extension apertures 110 can slide along the elongated, curved length of the first downrod extension apertures 110, where pivoting movement about the second axis of rotation 122 is limited by the length of the first downrod extension apertures 110. Furthermore, the length of the first downrod extension aperture 110 should be such that there is no interference between the mount plate 50 and the downrod mount 90 during pivoting movement.

Utilizing the first and second pivot axes 120, 122, the portion of the ceiling fan 10 suspended below the ceiling fan hanger assembly 12 can pivot relative to the mount plate 50 mounted to the ceiling or structure. Utilizing the two pivot axes 120, 122, the ceiling fan 10 is permitted to pivot 360-degrees about an axis defined perpendicular to the mount plate 50, such that the ceiling fan 10 can pivot in any direction relative to the mount plate 50 at the connector bracket 72. The length of the second plate extension aperture 70 limits the pivoting movement about the first pivot axis 120 and the first downrod extension apertures 110 limits the distance of the pivoting movement about the second pivot axis 122.

In operation or installation, the mount plate 50 can be coupled to a ceiling or a structure. The connector bracket 72 can be coupled to the mount plate 50, and the downrod can be coupled to the connector bracket 72 at the downrod mount 90. The remainder of the ceiling fan 10 can be coupled to the downrod at the adapter assembly 30. The ceiling fan 10 can be pivoted about the two pivot axes 120, 122 until oriented in a desired position, such as with the blades 20 extending in a horizontal manner, or in an angled offset from the horizontal, as may be desirable for the particular installation. The fasteners 86 in the second plate extension apertures 70 and the first downrod extension aperture 110, being slid into the desired position, can be tightened to secure the ceiling fan 10 in the desired pivoted orientation at the ceiling fan hanger assembly 12. In this way, the connector bracket 72 can be lockable along the first pivot axis 120 and the second pivot axis 122 with the fasteners 86 in the second plate extension apertures 70 and the first downrod extension apertures 110. Locking the first and second pivot axes 120, 122 can provide for orienting the downrod 14, and thus the ceiling fan in a horizontal manner, or can be used to orient the ceiling fan in an angled manner as may be desirable.

The structurally rigid arrangement of the ceiling fan hanger assembly 12 reduces or prevents wiggle or vibration of the ceiling fan 10 about the ceiling fan hanger assembly 12 and ceiling fan 10 during operation. Furthermore, the ceiling fan hanger assembly 12 provides for a simplified, three-part assembly, including the mount plate 50, the connector bracket 72, and the downrod mount 90, each of which can be easily interconnected with the set of fasteners 86. This simplified assembly minimizes production and manufacture costs, while facilitating and simplifying installation.

Figure 4:
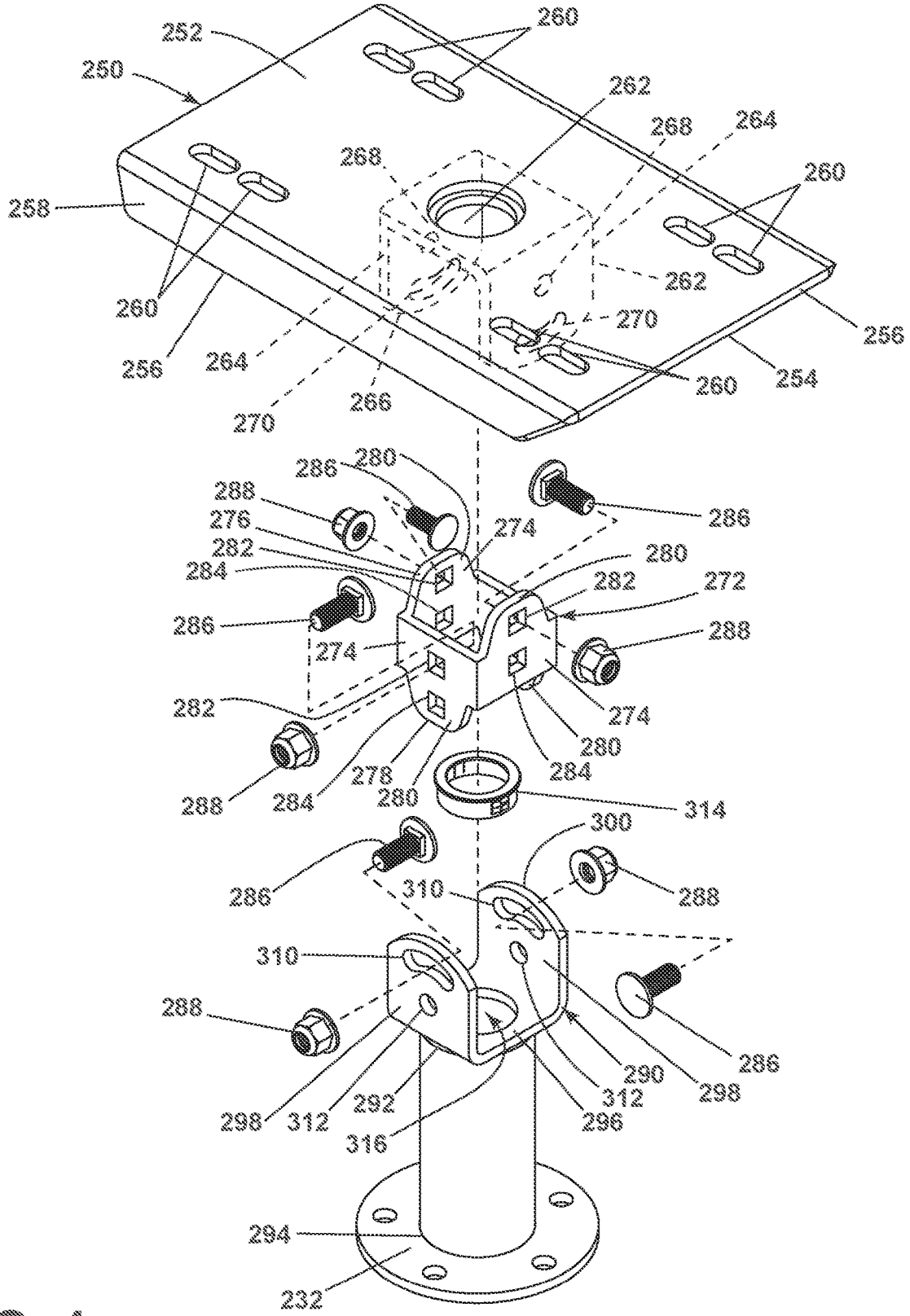
FIG. 4 is an exploded view of an alternative hanger assembly for suspending a ceiling fan.
Figure 5:
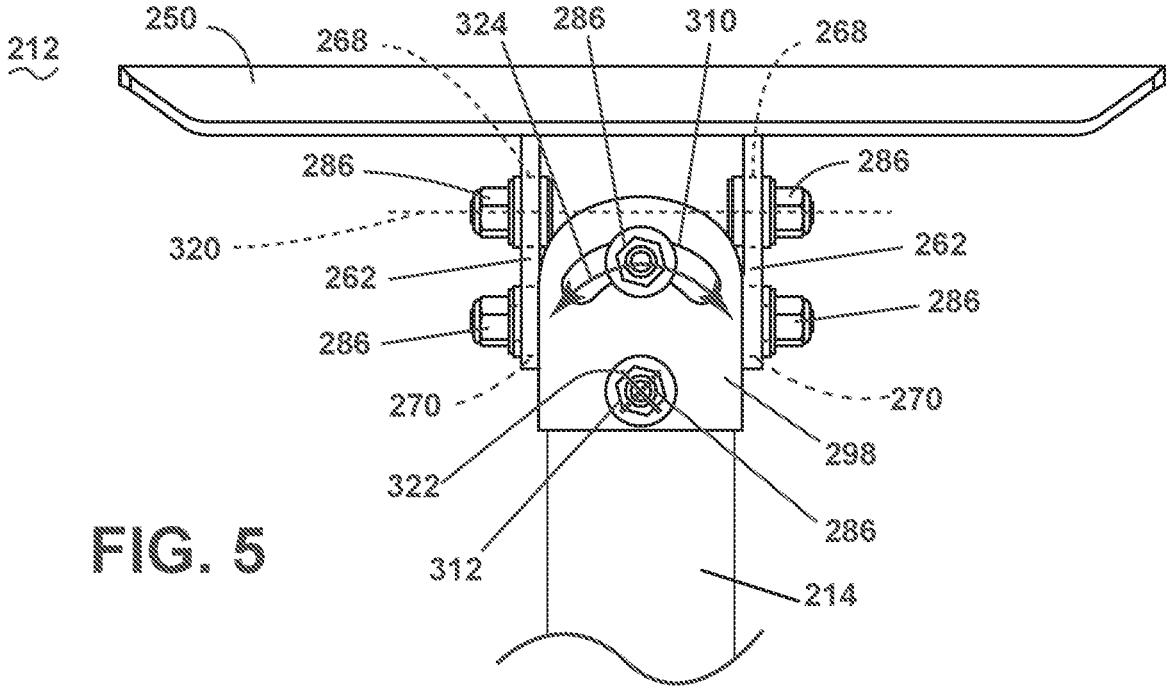
FIG. 5 is a side view of the assembled hanger assembly of FIG. 4, showing pivoting movement about a first axis of rotation.
Figure 6:
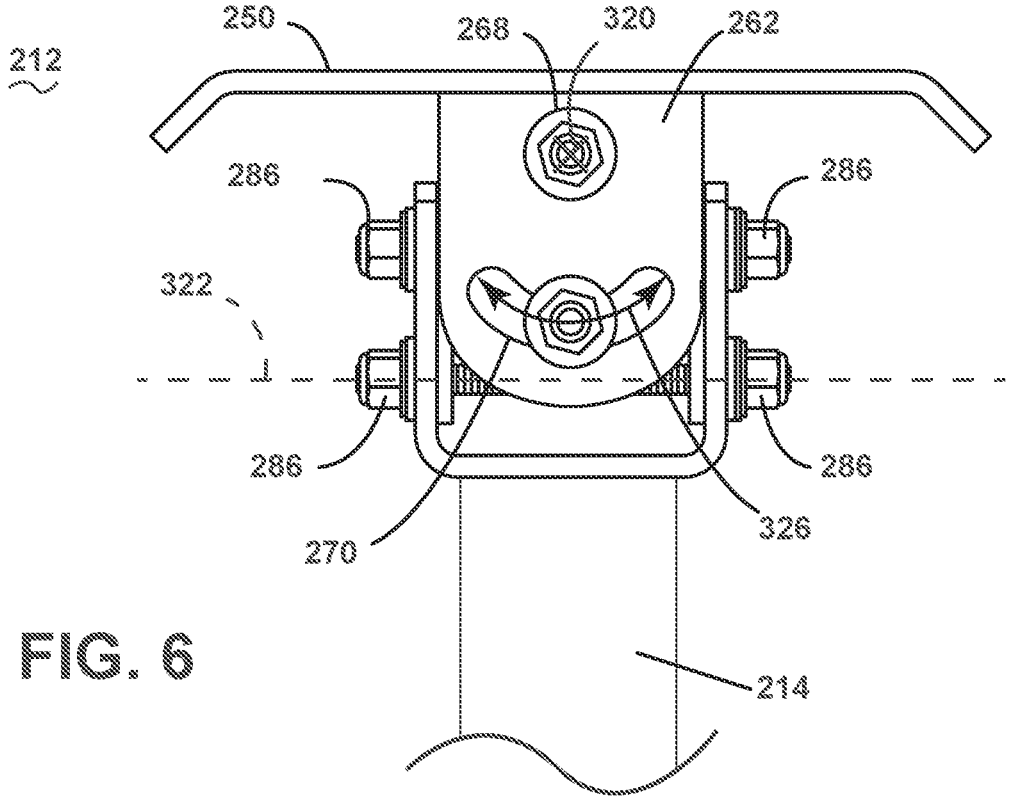
FIG. 6 is another side view of the assembled hanger assembly of FIG. 4, rotated 90-degrees from that of FIG. 5, showing pivoting movement about a second axis of rotation.

FIGS. 4-6 include an alternative ceiling fan hanger assembly 212 that can be substantially similar to the ceiling fan hanger assembly 12 of FIGS. 1-3. Therefore, similar numerals will be used to describe similar elements, increase by a value of two-hundred, and the discussion will be limited to differences between the two.

Referring specifically to FIG. 4, a set of plate extensions 262 (shown in broken line) extend from the mount plate 250 toward the downrod 214 and includes linear edges 264 that can extend perpendicular to the lower surface 254 of the mount plate 250. A set of downrod extensions 298 can be sized and shaped similar to or identical to the set of plate extensions 262, and can extend from a bottom wall 296 of the downrod mount 290 of the downrod 214 toward the mount plate 250. Such a sizing reduces or prevents potential contact between the set of plate extensions 262 and the downrod extensions 298.

A connector bracket 272 can includes a decreased length between a top edge 276 and a bottom edge 278, as compared with that of FIGS. 2-3, and can include upper and lower openings 282, 284. The decreased length between the top edge 276 and the bottom edge 278 necessarily provides for a decreased distance between the upper and lower openings 282, 284. The decreased distance between the upper and lower openings 282, 284 provides for defining a lesser radius for pivoting the ceiling fan hanger assembly 212, further discussed in regard to FIGS. 5 and 6. A lesser radius provides for a greater range of pivoting movement for the ceiling fan hanger assembly 212, without providing for large increases in the length of the second plate extension aperture 270 in the plate extensions 262 or the first downrod extension aperture 310 in the downrod extensions 298. More specifically, the decreased length for the connector bracket 272 defines a decreased pivoting radius, which provides for increased potential pivoting movement. However, it should be appreciated that the sizing or length of the connector bracket 272 should be of a length suitable to prevent interference between the plate extensions 262 and the downrod extensions 298 during pivoting movement about the ceiling fan hanger assembly 212.

Referring now to FIG. 5, a front view of the ceiling fan hanger assembly 212 is shown in the assembled position, with a downrod extension 298 visible. The downrod extension 298 includes the first downrod extension aperture 310 and the second downrod extension aperture 312, with the first downrod extension aperture 310 formed as an elongated, curved aperture. A fastener 286 extends through each of the first and second downrod extension apertures 310, 312, such that the fastener 286 in the first downrod extension aperture 310 can slide along the first downrod extension aperture 310, pivoting about a pivot axis 322 defined by the fastener 286 in the second downrod extension apertures 312. The pivot axis 322 extends into the page as shown and is represented by an "X" over the fastener 286 at the second downrod extension aperture 312. Such pivoting movement is represented by the first arrow 324.

Similarly, each of the plate extensions 262 includes a first plate extension aperture 268 and a second plate extension aperture 270, with a fastener 286 provided in each of the first and second plate extension apertures 268, 270. Another pivot axis 320 can be defined through by the fasteners 286 in the first plate extension apertures 268.

Referring now to FIG. 6, showing a front view of one plate extension 262, the first plate extension aperture 268 can be a rounded or squared aperture, while the second plate extension aperture 270 is an elongated, curved aperture, similar or identical to the first downrod extension aperture 310 in the downrod extensions 298. The fastener 286 in the second plate extension aperture 270 can slide along the second plate extension aperture 270, pivoting about the pivot axis 320 defined at the fasteners 286 in the first plate extension aperture 268, extending into the page as shown and represented by an "X" over the fastener 286 at the first plate extension aperture 268. Pivoting movement is represented by arrow 126, pivoting about the pivot axis 320.

Therefore, the ceiling fan hanger assembly 212, as shown in FIGS. 4-6, can pivot about two pivot axes 320, 322 defined perpendicular to one another, providing for 360-degrees of pivoting movement of the downrod 214 relative to the mount plate 250. The shortened height of the connector bracket 272, as compared with that of the connector bracket 72 of FIG. 1, provides for a greater rate of pivoting movement as defined by the fasteners 286 sliding along the elongated, curved apertures 270, 310, without requiring an increase in sizing of the plate extensions 62, the downrod extensions 98, or an increase in length of the curved apertures 270, 310. More specifically, the shortened height of the connector bracket 272 provides for a smaller radius for pivoting about the two pivot 320, 322, which results in an increased range of pivoting movement. Furthermore, the ceiling fan hanger assembly 212 provides for a simplified, three-part assembly, including the mount plate 250, the connector bracket 272, and the downrod, each of which can be easily interconnected with the set of fasteners 286. This simplified assembly minimizes production and manufacture costs, while facilitating and simplifying installation.

Figure 7:
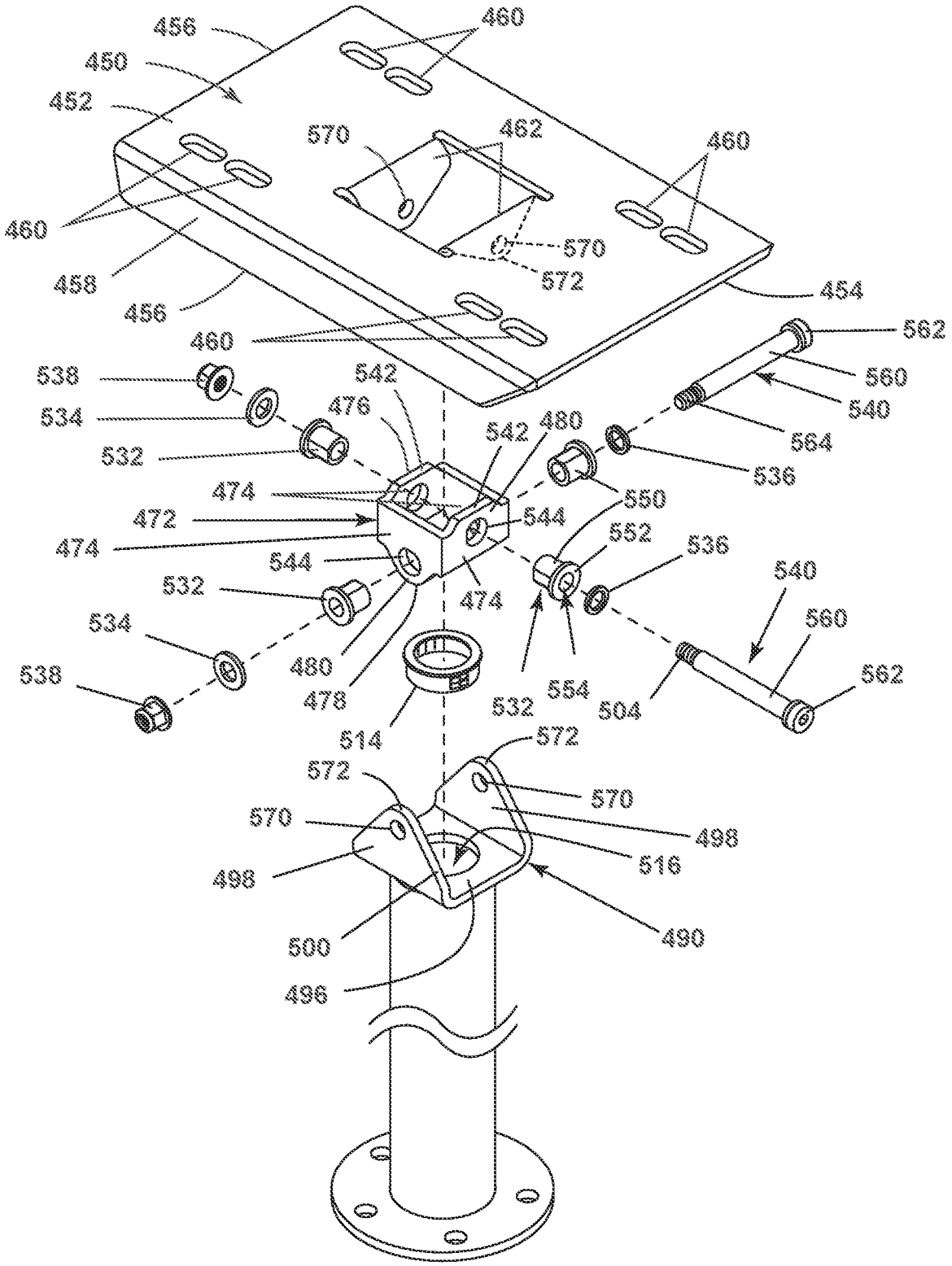
FIG. 7 is an exploded view of another alternative hanger assembly for suspending a ceiling fan.
Figure 8:
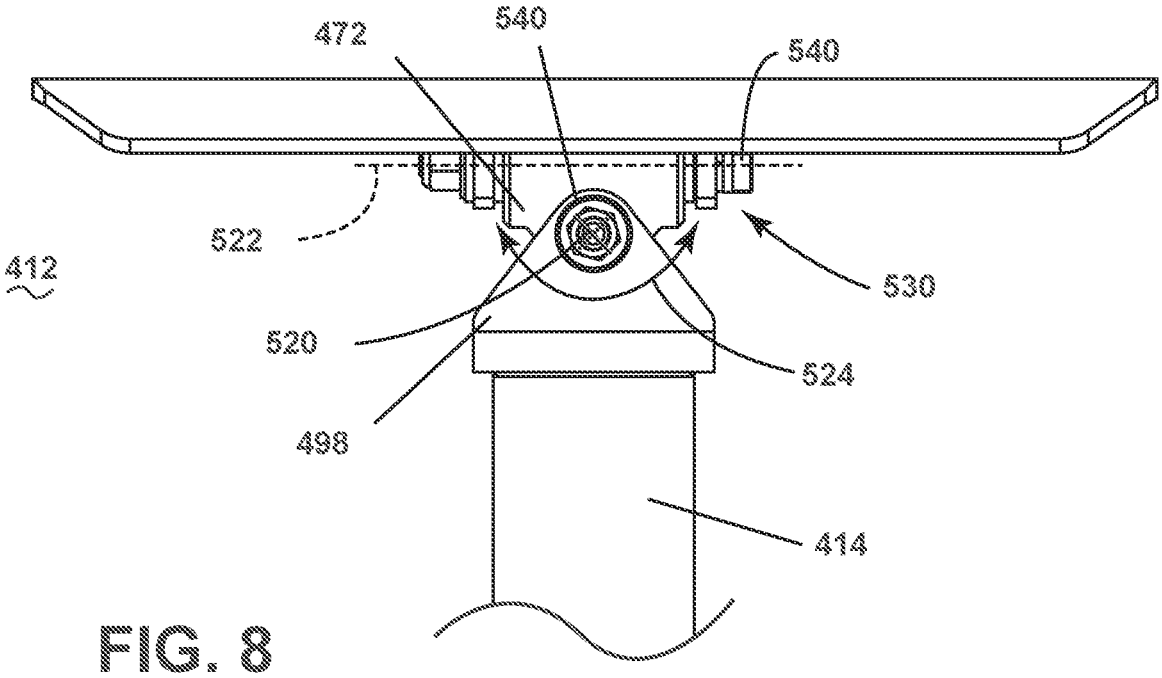
FIG. 8 is a side view of the assembled hanger assembly of FIG. 7, showing pivoting movement about a first axis of rotation.
Figure 9:
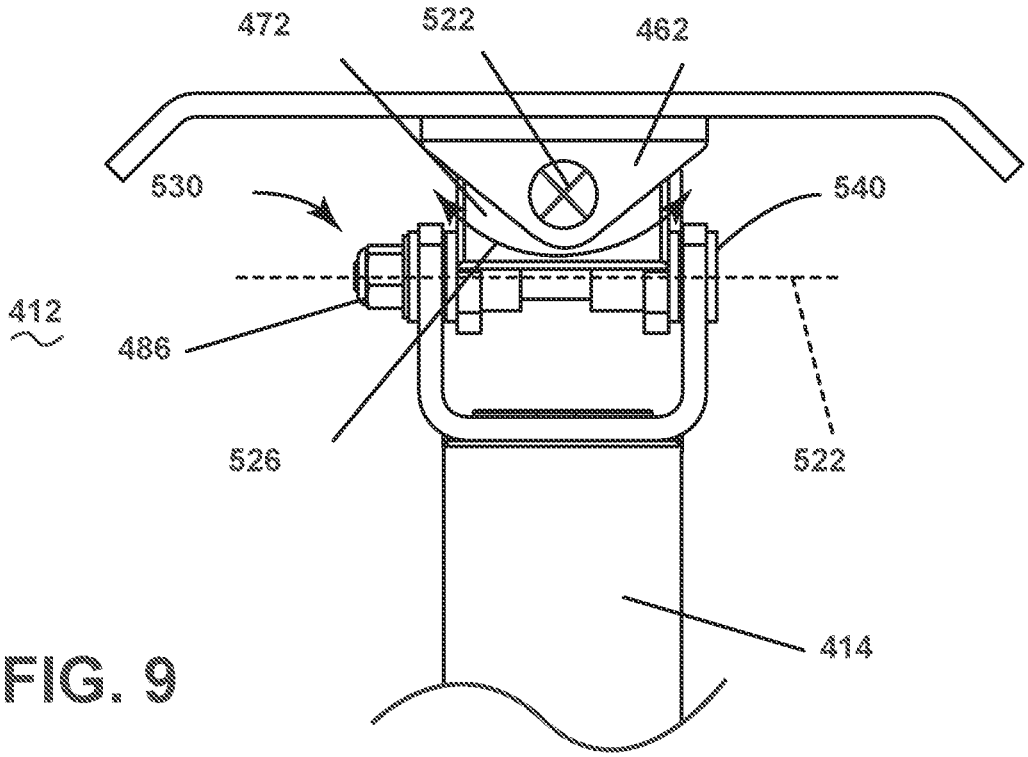
FIG. 9 is another side view of the assembled hanger assembly of FIG. 7, rotated 90-degrees from that of FIG. 8, showing pivoting movement about a second axis of rotation.

FIGS. 7-9 include an alternative ceiling fan hanger assembly 412 that can be substantially similar to the ceiling fan hanger assembly 12 of FIGS. 1-3. Therefore, similar numerals will be used to describe similar elements, increase by a value of four-hundred, and the discussion will be limited to differences between the two.

Referring now to FIG. 7 in particular, the ceiling fan hanger assembly 412 includes a connector bracket assembly 530. The connector bracket assembly 530 can include a connector bracket 472, a set of bushings 532, a set of washers 534, a set of lock washers 536, a set of nuts 538, and a set of bolts 540. The connector bracket 472 includes four sidewalls 474 that terminate at a top edge 476 and a bottom edge 478, with a set of tabs 480 extending from the top and bottom edges 476, 478. Each edge 476, 478 includes two tabs 480 provided on opposing sidewalls 474, such that each sidewall 474 includes one tab 480 on either of the top or bottom edges 476, 478, and are arranged in an alternating manner. The tabs 480 on the top edge 476 are truncated to include a flat edge 542, while the tabs 480 on the bottom edge 478 are rounded. However, any suitable shape for the tabs 480 is contemplated. One aperture 544 is provided in each of the sidewalls 474, and is at least partially provided in the tabs 480, while it is contemplated that the apertures 544 can be positioned anywhere in the sidewalls 474, such that apertures 544 in opposing sidewalls 474 are aligned with one another.

Each bushing 532 includes an annular, peripheral sidewall 550 that terminates at a lip 552 having a diameter greater than the sidewall 550. The sidewall 550 defines an interior 554 for the bushing 532. The sidewall 550 of the bushing 532 can be sized complementary to the apertures 544 in the connector bracket 472, such that the bushings 532 can insert into the apertures 544, with the lip 552 abutting against the sidewalls 474 on the exterior of the connector bracket 472.

The bolt 540 can be a shoulder bolt, for example, and can include a smooth body 560, a head 562 at one end of the body 560, and a thread end 564 at the other end of the body 560. The set of washers 534 and the set of lock washers 536 can be sized to slide along the body 560 of the bolt 540. The nuts 538 can be sized to thread onto the threaded end 564 of the bolt 540.

The mount plate 450 includes the pair of plate extensions 462 and the downrod 414 includes the pair of downrod extensions 498. Each extension 462, 498 includes a rounded triangular shape, while other shapes are contemplated. One plate extension aperture 570 is provided in each of the extensions 462, 498, and can be positioned near a tip 572 of the triangular shaped extensions 462, 498.

In assembling the ceiling fan hanger assembly 412, the bushings 532 can be inserted into the apertures 544 of the connector bracket 472. The connector bracket 472 can then be positioned between the plate extensions 462 of the mount plate 450. One lock washer 536 can be slid onto one bolt 540 until it abuts the head 562. The bolts 540 can insert through the connector bracket 472 and the bushings 532, as well as the complementary-arranged plate extensions 462, such that one bolt 540 extends through both plate extensions 462. The threaded end 564 as well as a portion of the body 560 of the bolts 540 can extend from the connector bracket 472, and the adjacent downrod extensions 498 or plate extension 462. The washers 534 and the nuts 538 can then be slide and threaded onto the bolts 540. In this way, the head 562 of the bolt 540 and the nuts 538 secure the bolts 540 through the plate extensions 462 and the connector bracket 472.

Additionally, the downrod extensions 498 can be positioned on either side of the connector bracket 472 opposite of the plate extensions 462. The remaining lock washer 536 can be slid onto the remaining bolt 540, and the bolt 540 can be inserted through the connector bracket 472 and the unoccupied bushings 532, and thus, through the downrod extensions 498. The bolt 540 can be secured with the lock washer 536 and one nut 538.

In this way, the connector bracket assembly 530 defines two pivot axes 520, 522, defined along both bolts 540. The connector bracket assembly 530, and thus, the ceiling fan hanger assembly 412, can pivot about both pivot axes, providing for 360-degrees of rotation for the downrod 414 relative to the mount plate 450. When pivoting, the bushing 532 provides for rotation of the bolt 540 relative to the connector bracket 472. The bushing 532 can be made of a hardened metal or wear-resistant material, to prevent cracking or damage during use. When a desired position is achieved, the nut 538 can be tightened, thereby tightening the lock washers 536, to secure the pivoted location of the ceiling fan hanger assembly 412.

Referring now to FIG. 8, showing a front view of one of the downrod extensions 498, the downrod 414 and the connector bracket assembly 530 can pivot about the first pivot axis 520 along one bolt 540, represented by an "X" at the bolt 540, with pivoting movement represented by a first arrow 524. Referring to FIG. 9, showing a front view of one of the plate extensions 462, the connector bracket assembly 530 and the connector bracket 472 can pivot about the second pivot axis 522 along the other bolt 540.

Such an arrangement provides for 360-degrees of rotation for the ceiling fan hanger assembly 412, which can lock and secure at a rotated position. The ceiling fan hanger assembly 412 only utilizes a single set of aperture with each of the connector bracket 472 and the plate extension 462 or the downrod extensions 498, as opposed to the pairs of apertures shown in FIGS. 1-6. This provides for utilizing lesser elements, as well as a greater range of pivoting movement. Furthermore, the ceiling fan hanger assembly 412 provides for a simplified, three-part assembly, including the mount plate 450, the connector bracket 472, and the downrod, each of which can be easily interconnected with the set of fasteners 486. This simplified assembly minimizes production and manufacture costs, while facilitating and simplifying installation.

To the extent not already described, the different features and structures of the various embodiments of the present disclosure may be used in combination with each other as desired. For example, one or more of the features illustrated and/or described with respect to FIG. 1-3 or 4-6 can be used with or combined with one or more features illustrated and/or described with respect to the other as shown in FIGS. 7-9, as well as other combination not explicitly described. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While aspects of the present disclosure have been specifically described in connection with certain specific embodiments thereof, it is to be understood that this is by way of illustration and not of limitation. Reasonable variation and modification are possible within the scope of the forgoing disclosure and drawings without departing from the spirit of the present disclosure, which is defined in the appended claims.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ceiling fan hanger assembly comprising:

a motor assembly;

a mount plate having a pair of spaced plate extensions;

a downrod suspending the motor assembly from the mount plate, the downrod having opposing first and second ends including a pair of spaced downrod extensions extending from the first end which overlap the pair of spaced plate extensions; and a connector bracket including a top edge and a bottom edge, with a first pair of tabs arranged on the top edge and a second pair of tabs arranged on the bottom edge, wherein the connector bracket is pivotally connected to the pair of spaced plate extensions at the first pair of tabs to define a first pivot axis, and pivotally connected to the pair of spaced downrod extensions at the second pair of tabs to define a second pivot axis, which is different from the first pivot axis.

2. The ceiling fan hanger assembly of claim 1 further comprising first openings aligned among the pair of spaced plate extensions defining the first pivot axis.

3. The ceiling fan hanger assembly of claim 2 further comprising second openings aligned among the pair of spaced downrod extensions defining the second pivot axis.

4. The ceiling fan hanger assembly of claim 3 wherein the second openings include two downrod extension apertures provided in each downrod extension of the pair of spaced downrod extensions.

5. The ceiling fan hanger assembly of claim 4 wherein the first openings include two plate extension apertures provided in each plate extension of the pair of spaced plate extensions.

6. The ceiling fan hanger assembly of claim 5 wherein one of the two downrod extension apertures in each downrod extension is shaped as an elongated, curved aperture and one of the two plate extension apertures in each plate extension is shaped as an elongated, curved aperture.

7. The ceiling fan hanger assembly of claim 1 wherein the pair of spaced downrod extensions terminate between the pair of spaced plate extensions.

8. The ceiling fan hanger assembly of claim 1 wherein the connector bracket includes four sidewalls and at least one opening is provide in each sidewall.

9. The ceiling fan hanger assembly of claim 8 wherein the at least one opening in each sidewall includes two openings provided in each sidewall, with one opening of the two openings in each sidewall positioned in the set of tabs.

10. The ceiling fan hanger assembly of claim 1 further comprising a first set of fasteners for fastening the mount plate to the connector bracket at the pair of spaced plate extensions and a second set of fasteners for fastening the connector bracket to the downrod at the pair of spaced downrod extensions.

11. The ceiling fan hanger assembly of claim 10 wherein the first set of fasteners further includes a first set of bushings and the second set of fasteners includes a second set of bushings.

12. A ceiling fan hanger assembly comprising:

a mount plate including a pair of spaced plate extensions with each plate extension having a plate extension aperture;

a downrod with a first end and a second end and a downrod mount provided at the first end having a bottom wall and a pair of spaced downrod extensions extending from the bottom wall each including a downrod extension aperture; and a connector bracket pivotally connected to the pair of spaced plate extensions at the plate extension apertures to define a first pivot axis, and pivotally connected to the pair of spaced downrod extensions at the downrod extension apertures to define a second pivot axis, which is perpendicular to the first pivot axis, wherein each downrod extension includes a first portion and a second portion, with the first portion being longer and thinner than the second portion relative to a longitudinal axis defined along the downrod;

wherein the connector bracket includes an upper edge and a lower edge, and includes four tabs, with two tabs provided on the upper edge and two tabs provided on the lower edge.

13. The ceiling fan hanger assembly of claim 12 wherein each sidewall includes one tab, and the tabs are arranged on the upper edge on opposing sidewalls and on the lower edge on opposing sidewalls that do not include the tabs arranged on the upper edge.

14. The ceiling fan hanger assembly of claim 13 wherein at least one connector opening is provided in each sidewall and is at least partially provided in the tabs.

15. A ceiling fan hanger assembly comprising:

a mount plate including a pair of opposing plate extensions each having a plate extension aperture;

a downrod including a downrod mount having a pair of opposing downrod extensions each including a downrod extension aperture; and a connector bracket including four sidewalls with each sidewall including an opening with a set of bushings provided in each of the openings, the connector bracket further including a top edge and a bottom edge, with a first pair of tabs arranged on the top edge and a second pair of tabs arranged on the bottom edge, wherein the connector bracket is pivotally connected to the pair of opposing plate extensions at the first pair of tabs to define a first pivot axis, and pivotally connected to the pair of opposing downrod extensions at the second pair of tabs;

wherein the connector bracket pivotally connects to the plate extensions to define a first pivot axis and pivotally connects to the downrod extensions to define a second pivot axis, and the first pivot axis and the second pivot axis pivots about the set of bushings.

* * * * *